US008667651B2

(12) United States Patent
Wang

(10) Patent No.: US 8,667,651 B2
(45) Date of Patent: Mar. 11, 2014

(54) COMBINED DIVING UTENSIL

(76) Inventor: Ching-Wen Wang, Shin-chuang (TW)

( * ) Notice: Subject to any disclaimer, the term of this patent is extended or adjusted under 35 U.S.C. 154(b) by 0 days.

(21) Appl. No.: 13/370,515

(22) Filed: Feb. 10, 2012

(65) Prior Publication Data

US 2013/0205551 A1 Aug. 15, 2013

(51) Int. Cl.
*A63B 31/11* (2006.01)
*A44B 11/25* (2006.01)

(52) U.S. Cl.
USPC ..... 24/170; 24/615; 24/625; 24/325; 24/324; 24/323; 24/322.1; 441/64

(58) Field of Classification Search
USPC ..... 24/322.1–325, 702, 170, 578.12, 24/578.13, 578.15, 615, 616, 625; 2/452; 441/64
See application file for complete search history.

(56) References Cited

U.S. PATENT DOCUMENTS

| | | | | | |
|---|---|---|---|---|---|
| 4,795,385 | A * | 1/1989 | Matsuoka | 441/64 |
| 5,561,891 | A * | 10/1996 | Hsieh | 24/581.1 |
| 6,185,794 | B1 * | 2/2001 | Maggi | 24/170 |
| 6,398,604 | B1 * | 6/2002 | Kawashima et al. | 441/64 |
| 6,463,640 | B1 * | 10/2002 | Toth | 24/648 |

* cited by examiner

*Primary Examiner* — Robert J Sandy
(74) *Attorney, Agent, or Firm* — Egbert Law Offices, PLLC

(57) ABSTRACT

A combined diving utensil has a buckling assembly, a seesaw and a fastening element. The buckling assembly includes a male buckle and a female buckle. Of which, one end of the female buckle is provided with an opening, and the other end provided with a mating joint. One end of the male buckle is provided with a threading portion, and the other end provided with an extension coupled with the mating joint. A plurality of ribs are set on one surface of the fastening element, which is set on the threading portion of the male buckle. A stopper is set close to the end of the fastening element. The seesaw is provided with a thrust rib plate, which is mated with a plurality of ribs on the fastening element and pivoted on the female buckle via the fulcrum.

8 Claims, 12 Drawing Sheets

COMBINED DIVING UTENSIL

CROSS-REFERENCE TO RELATED U.S. APPLICATIONS

Not applicable.

STATEMENT REGARDING FEDERALLY SPONSORED RESEARCH OR DEVELOPMENT

Not applicable.

NAMES OF PARTIES TO A JOINT RESEARCH AGREEMENT

Not applicable.

REFERENCE TO AN APPENDIX SUBMITTED ON COMPACT DISC

Not applicable.

BACKGROUND OF THE INVENTION

1. Field of the Invention

The present invention relates generally to a combined diving utensil, and more particularly to an innovative one which allows to adjust freely the length of flippers and to prevent them from falling off.

2. Description of Related Art Including Information Disclosed Under 37 CFR 1.97 and 37 CFR 1.98.

Flippers are an indispensable device for snorkeling or diving, so they must be buckled securely onto the soles. Generally, flippers are divided into heel-free and shoe-shaped ones, of which heel-free flippers are provided with a shoe cover and buckled circularly onto the heel to prevent falling off, so adjustable heel-free flippers are a preferred option.

If the users wear flippers, they may find it difficult to step into the diving area. Moreover, if the fastening element of the prior art is removed, at least one side is directly disengaged from the flippers, and the flippers cannot be disassembled or held simultaneously by the users.

Thus, to overcome the aforementioned problems of the prior art, it would be an advancement if the art to provide an improved structure that can significantly improve the efficacy.

Therefore, the inventor has provided the present invention of practicability after deliberate design and evaluation based on years of experience in the production, development and design of related products.

BRIEF SUMMARY OF THE INVENTION

The present invention is a combined diving utensil. The diving utensil includes a buckling assembly, seesaw and fastening element. The buckling assembly comprises of a male buckle and a female buckle. Of which, one end of the female buckle is provided with an opening, and the other end provided with a mating joint. One end of the male buckle is provided with a threading portion, and the other end provided with an extension coupled with the mating joint. A plurality of ribs are set on one surface of the fastening element, which is set on the threading portion of the male buckle. A stopper is set close to the end of the fastening element. The seesaw is provided with a thrust rib plate, which is mated with a plurality of ribs on the fastening element and pivoted on the female buckle via the fulcrum.

Although the invention has been explained in relation to its preferred embodiment, it is to be understood that many other possible modifications and variations can be made without departing from the spirit and scope of the invention as hereinafter claimed.

DETAILED DESCRIPTION OF THE INVENTION

The features, advantages and efficacies of the present invention will be more readily understood upon a thoughtful deliberation of the following detailed description of the preferred embodiments of the present invention with reference to the accompanying drawings.

Figure 3:
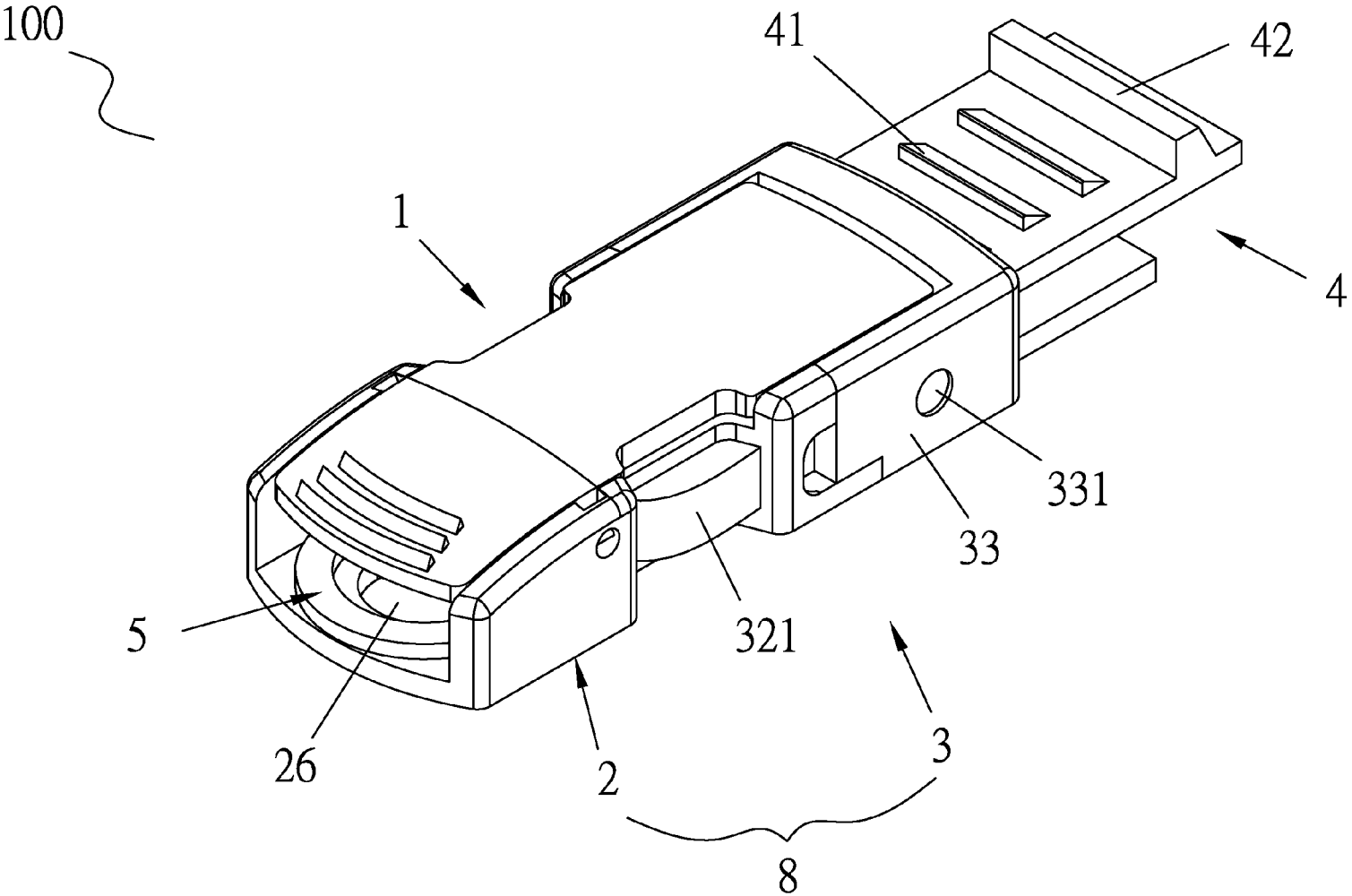
FIG. 3 is a perspective view of the present invention.

FIG. 3 depicts a perspective view of the present invention, wherein it comprises: a buckling assembly 8, seesaw 1 and fastening element 4. Of which, the buckling assembly 8 comprises of male buckle 3 and female buckle 2. A pressing strip 14 is set on the seesaw 1, while an elastic element 5 is set between the female buckle 2 and seesaw 1 below the pressing point. The male buckle 3 is fastened with the female buckle 2 via a reed 321, and the fastening element 4 is set at the threading portion 33 via a roller 331. Also, a plurality of ribs 41 are set on one surface of the fastening element 4, and a stopper 42 is set close to the end of the fastening element 4.

Referring to FIGS. 4-7, the female buckle 2 of the present invention is pivoted via the through-hole 21 onto the fulcrum 11 of the seesaw 1. The male buckle 3 is set on a fastening element 4 by a roller 331 of the threading portion 33 pivoted from the through-hole 34. With this structure, when the male buckle 3 and the female buckle 2 are buckled, the seesaw 1 will continuously cover the male buckle 3 and the female buckle 2.

One end of the female buckle 2 is provided with an opening 24, and the other end provided with a mating joint 23. The mating joint 23 is provided with at least a central channel 231 and at least two lateral channels 233 formed by at least two guiding plates 232. A lateral opening 22 linking the lateral channel 233 is set at both sides of the female buckle 2.

One end of the male buckle 3 is provided with a threading portion 33, and the other end provided with an extension 30 coupled with the mating joint 23. At least a central column 31 is extended from the center of the extension 30, and a lateral column 32 extended from both sides. An arrow-shaped hook 311 mated with the guiding plate 232 is set at the end of the central column 31.

Figure 4:
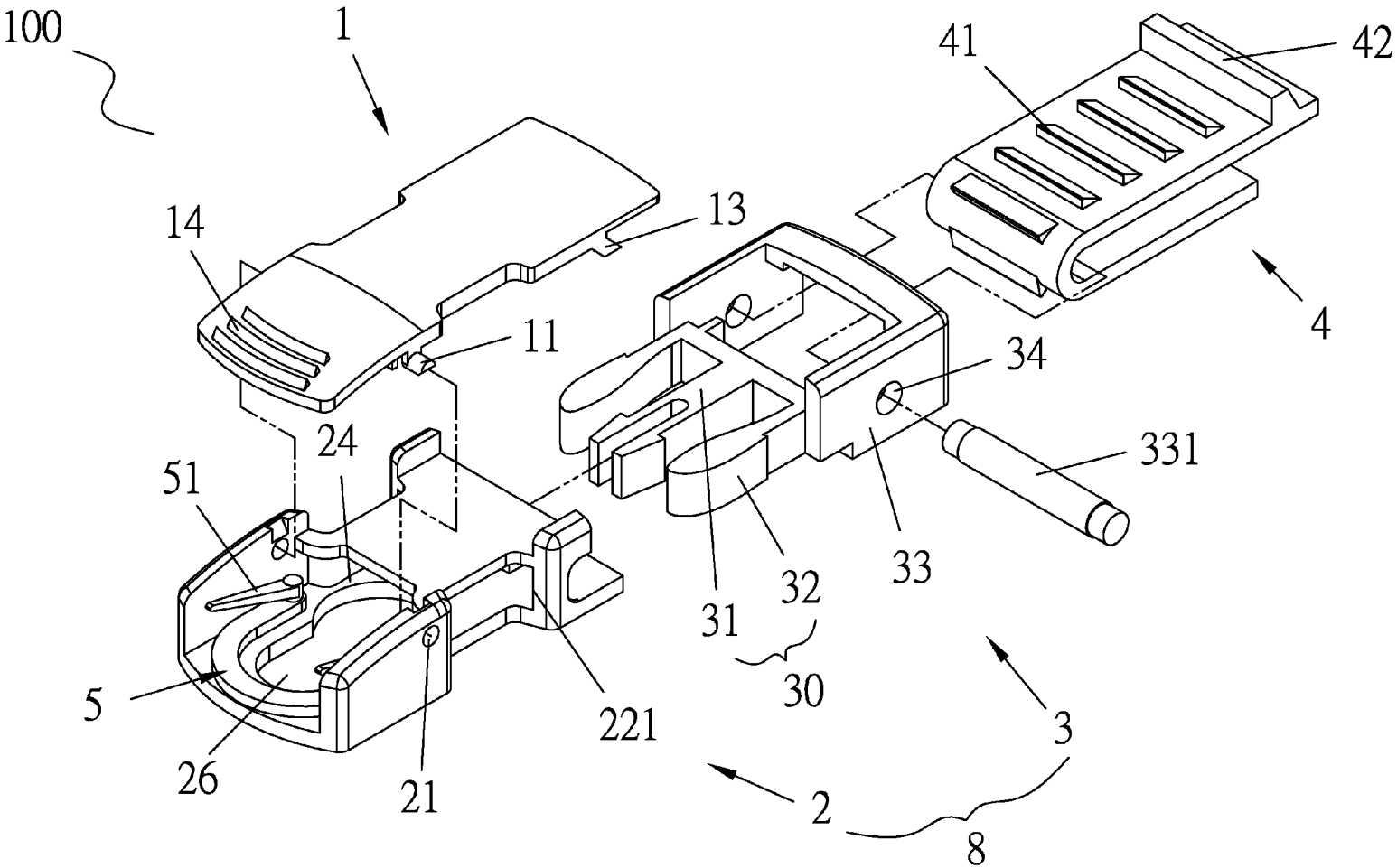
FIG. 4 is an exploded perspective view (1) of the present invention.
Figure 8:
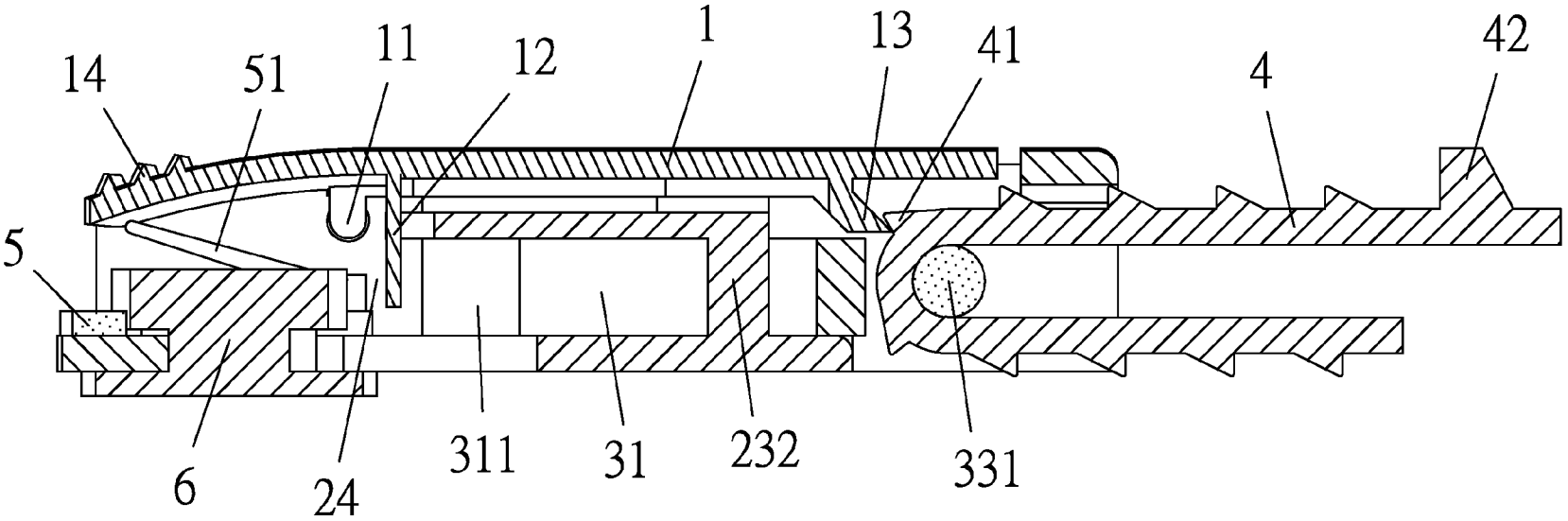
FIG. 8 is a sectional view of the buckling element of the present invention.

Referring to FIGS. 4 and 8, the opening 24 is extended to form a grooved seat 25, onto the lower flange of which a buckling hole 26 is set to buckle an object, e.g.: a buckling element 6 on a swimming device.

Referring to FIG. 8 (a sectional view of a buckling element 6 of the present invention), wherein the buckling element 6 is pivoted into the female buckle 2. The thrust rib plate 13 of the seesaw 1 is abutted with the ribs 41 on the fastening element 4, allowing for unidirectional adjustment. The stopper 42 of the fastening element 4 is larger than the ribs 41 on the fastening element 4, so as to prevent the fastening element 4 from being disengaged from the threading portion 33. The buckling element 6 is limited within the grooved seat 25 of the female buckle 2 by a downward baffle 12 of the seesaw 1.

Figure 5:
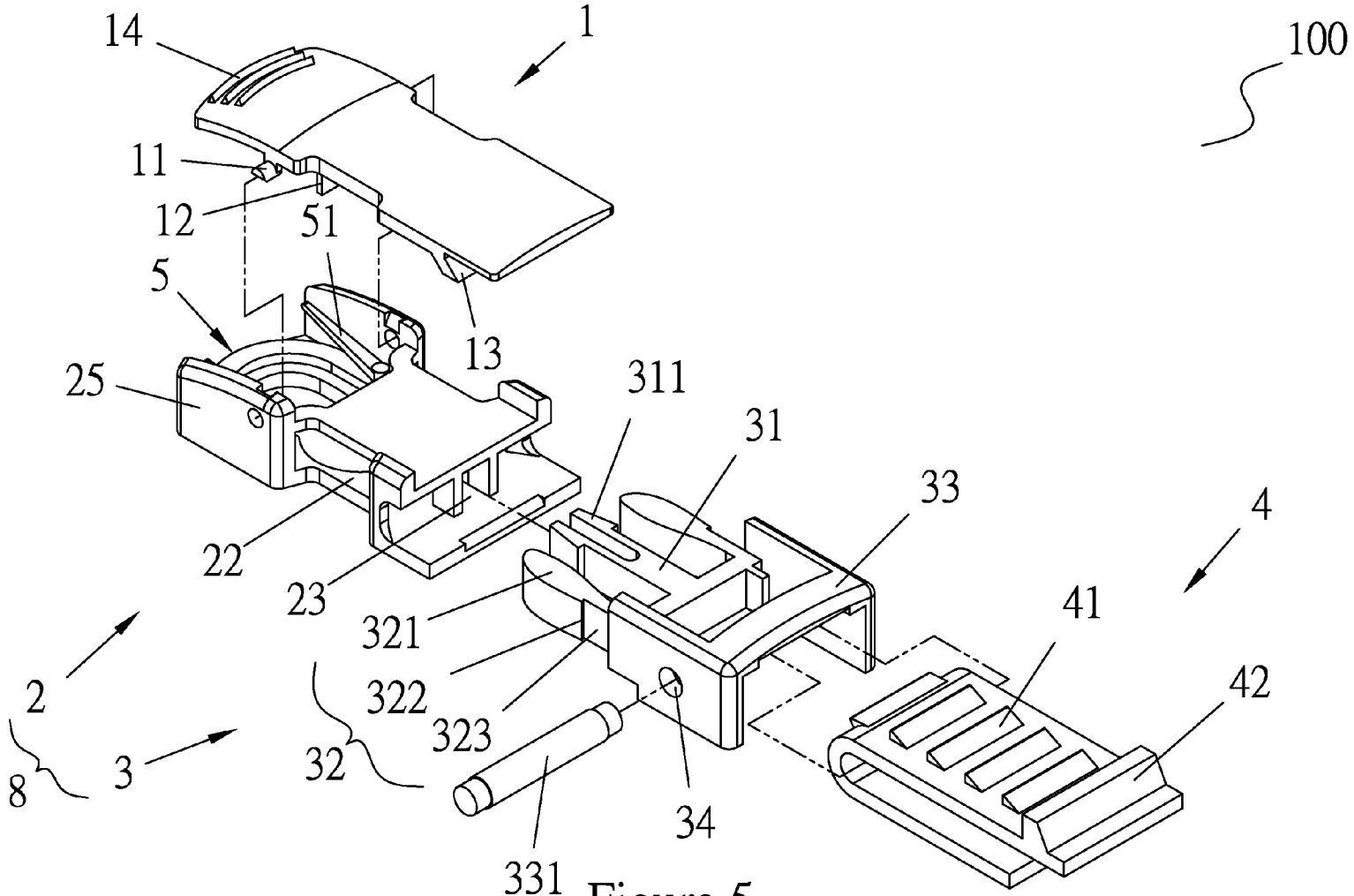
FIG. 5 is an exploded perspective view (2) of the present invention.
Figure 6:
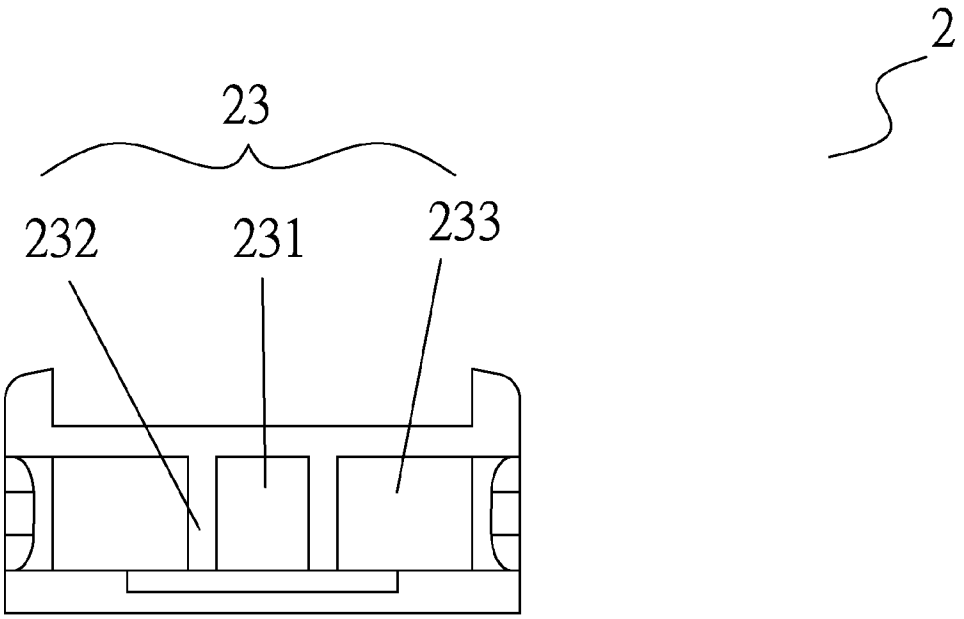
FIG. 6 is a rear view of female buckle of the present invention.
Figure 7:
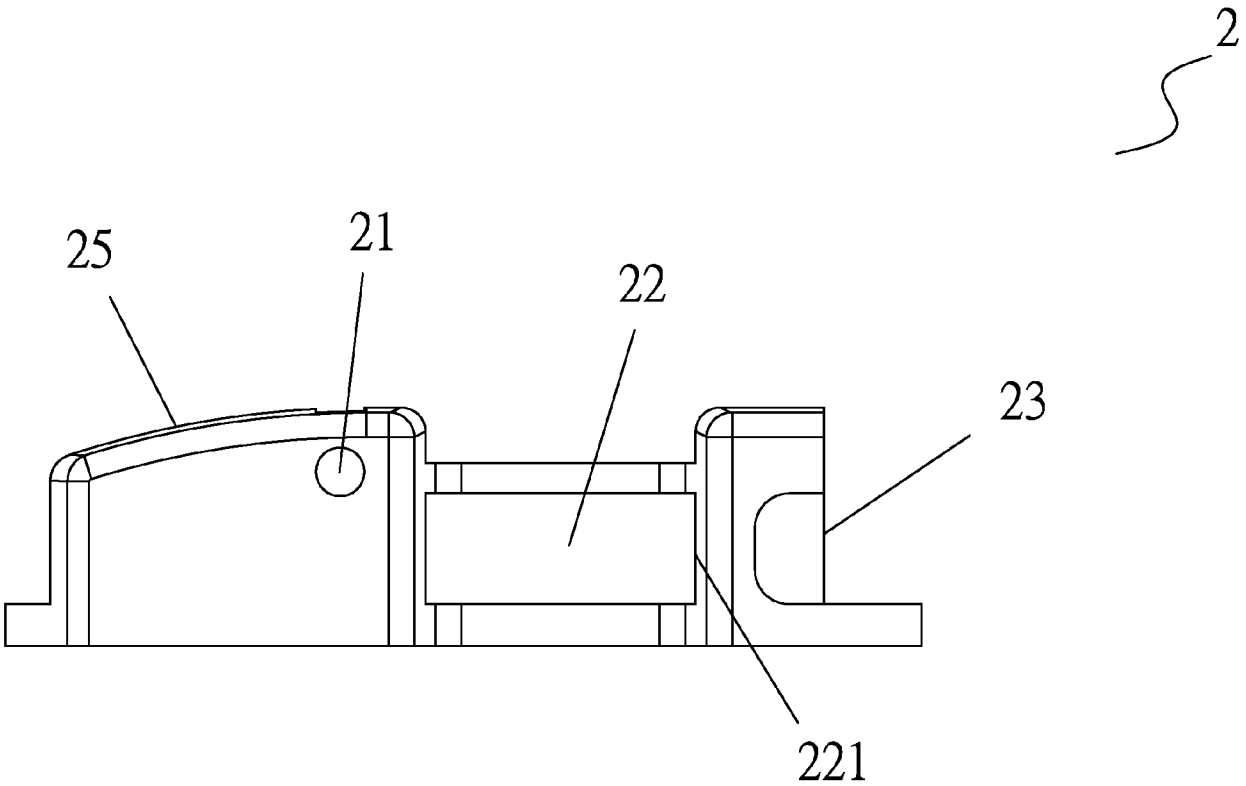
FIG. 7 is a lateral view of female buckle of the present invention.

Referring to FIGS. 4, 5 and 8, the elastic element 5 is set in the grooved seat 25, and located between the female buckle 2 and seesaw 1. The pushing point 51 of the elastic element 5 is set opposite to the pressing strip 14 of the seesaw 1. With this structure, the elastic element 5 will be deformed if a force is applied to push the pressing strip 14 towards the grooved seat 25. If the elastic element 5 is released, the pushing point 51 is permitted to release the pressing force towards opposite point and push the seesaw 1 back to its initial position. With adjustment of said fastening element 4, when the pressing strip 14 is pressed, the end of the seesaw 1 close to the male buckle 3 will be tilted, and the thrust rib plate 13 is lifted off from the contact position with rib 41 on the fastening element 4. In this way, the fastening element 4 could be adjusted bi-directionally. After the force is release, the seesaw 1 could be resumed, and the thrust rib plate 13 is returned to the pushing position in contact with the rib 41 on the fastening element 4, so the fastening element 4 is reset to unidirectional adjustment state.

Figure 9:
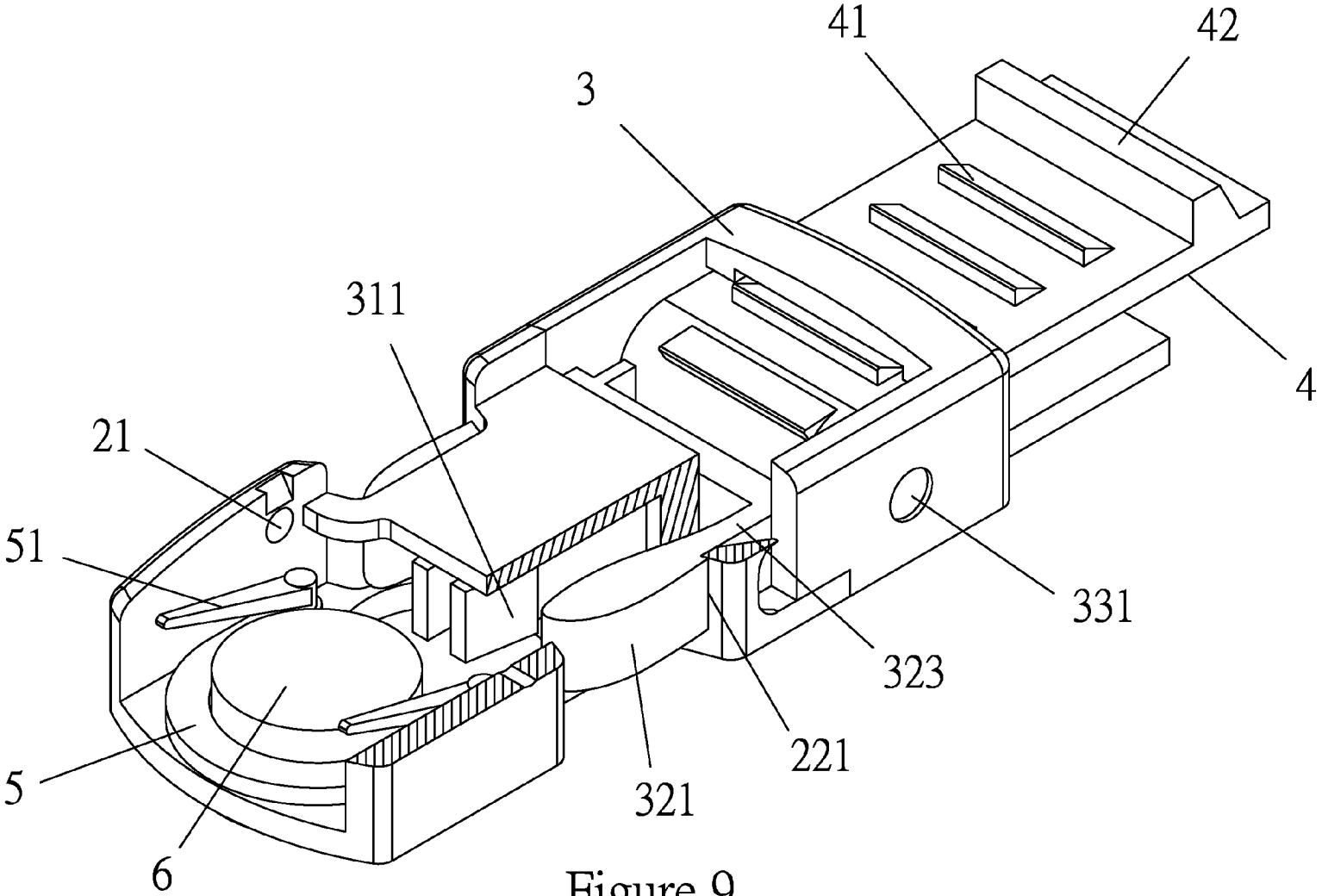
FIG. 9 is a partial sectional view of the lateral column and female buckle of the present invention.
Figure 10:
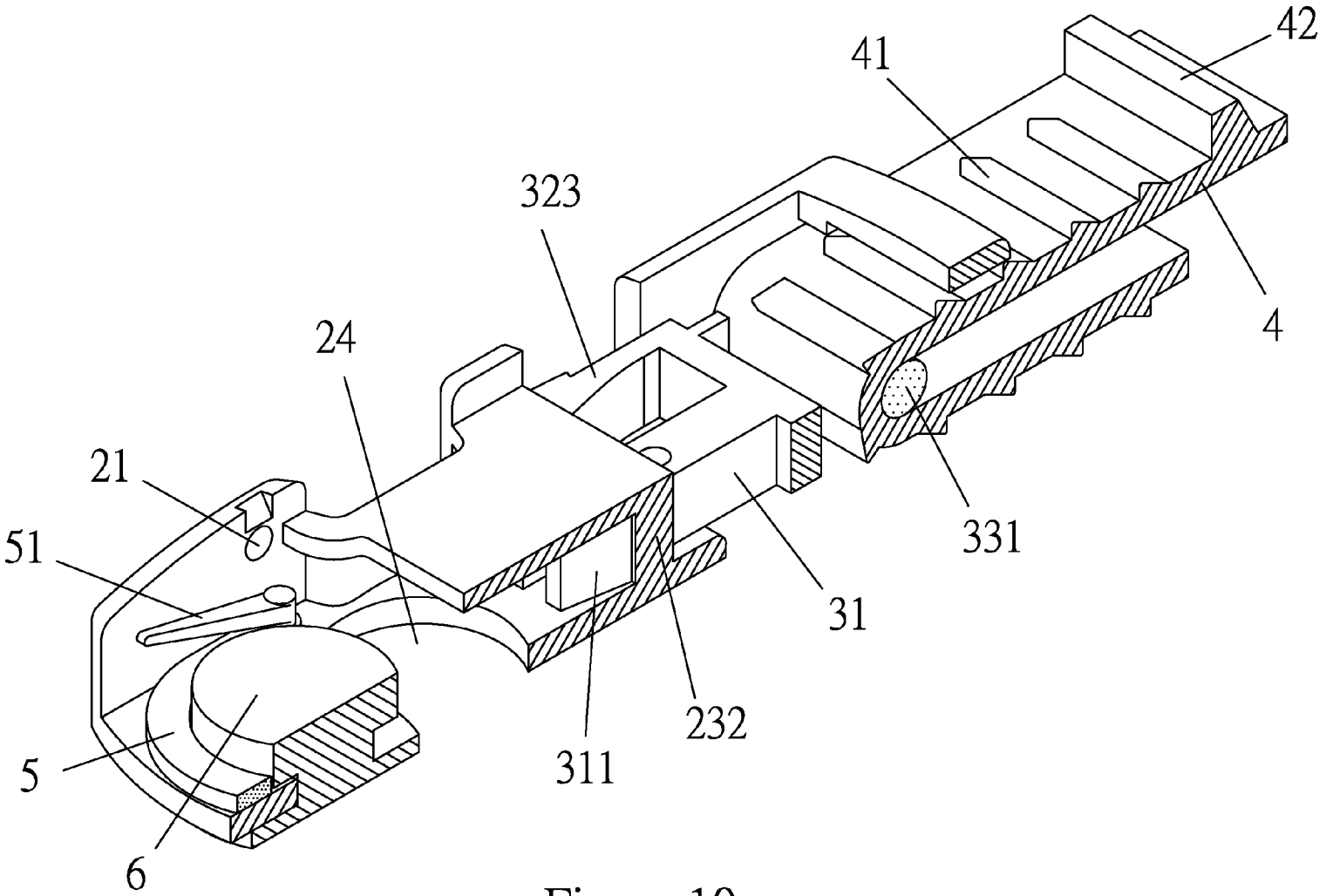
FIG. 10 is a partial sectional view of the central column and guiding plate of the present invention.

Referring to FIGS. 8-10, the male buckle 3 and female buckle 2 of the present invention are combined at the mating joint 23. Referring to FIG. 9, the male buckle 3 is provided with a central column 31 and two lateral columns 32, while the female buckle 2 is provided with a central channel 231 and two lateral channels 233 linking the lateral opening 22. The lateral column 32 of the male buckle 3 is extended by an elastic arm 323 to form a reed 321 and a trough 322. When the male buckle 3 and female buckle 2 are buckled, the reed 321 is extended out of the lateral opening 22, and the trough 322 is locked with the locking flange 221 of the lateral opening 22. Since the outer edge of the lateral column 32 is larger than the inner edge of the lateral channel 233, the elastic arm 323 could provide a force to prop up two lateral columns 32 for abutting the locking flange 221. When the male buckle 3 and female buckle 2 are to be disassembled, a force is applied to compress two lateral columns 32, and the elastic arm 323 on the lateral column 32 is deformed, such that outer edge of the lateral column 32 is almost equal to the inner edge of the lateral channel 233, and the male buckle 3 is disengaged from the female buckle 2.

Since the female buckle 2 is provided with a central channel 231 matching the central column 31 of the male buckle 3, and the outer edge of arrow-shaped hook 311 on the central column 31 is larger than the spacing between two guiding plates 232, the male buckle 3 and female buckle 2 are not disengaged when the arrow-shaped hook 311 is abutted with the guiding plate 232.

With the pattern of the present invention in collaboration with the adjustment mode of said fastening element 4, the thrust rib plate 13 has been disengaged from the contact position with rib 41 on the fastening element 4. In such a case, the fastening element 4 could be adjusted bi-directionally, while the male buckle 3 and female buckle 2 are still linked to the buckling object securely.

Figure 11:
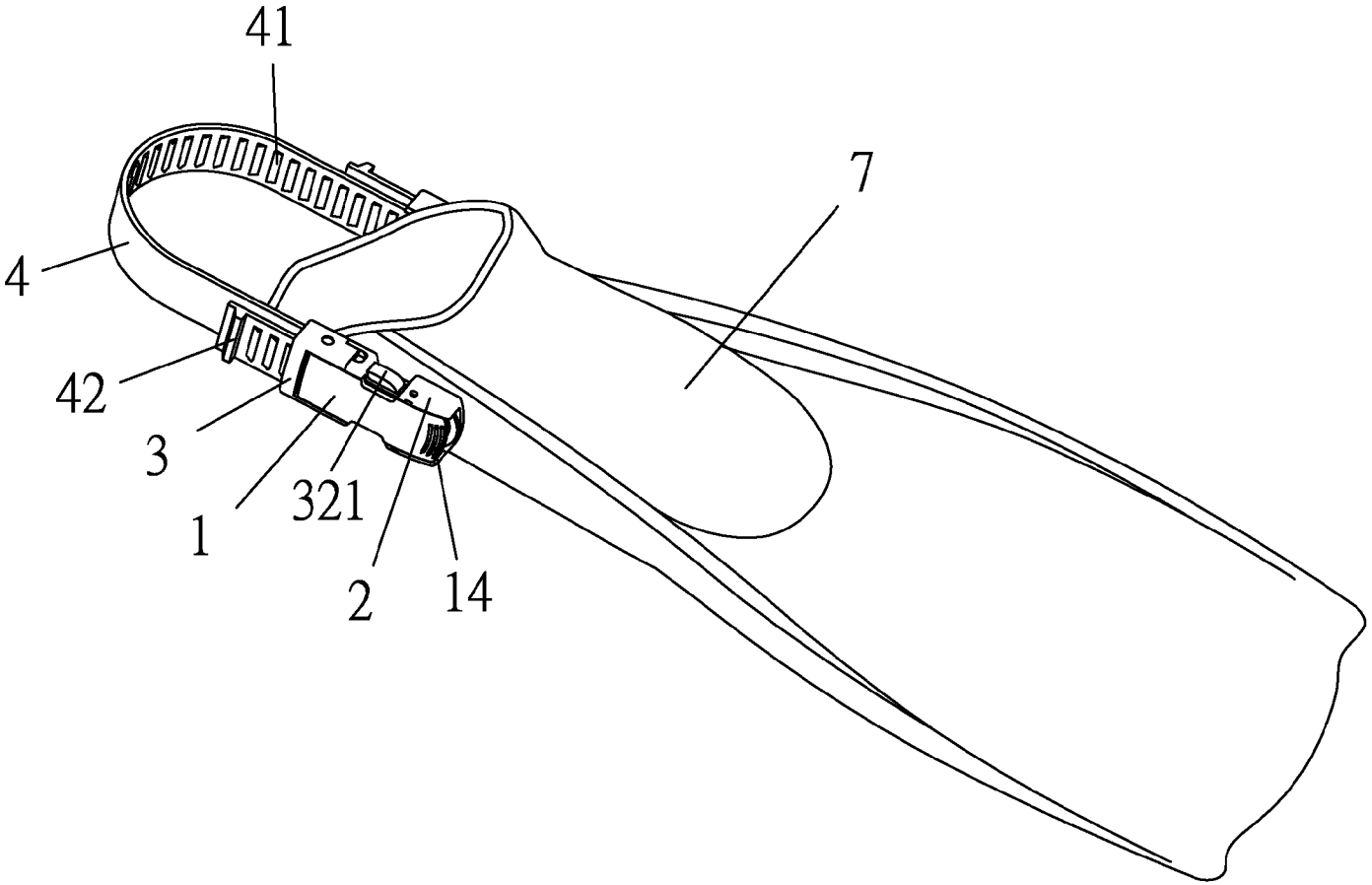
FIG. 11 is a schematic view of a preferred embodiment of the present invention.
Figure 12:
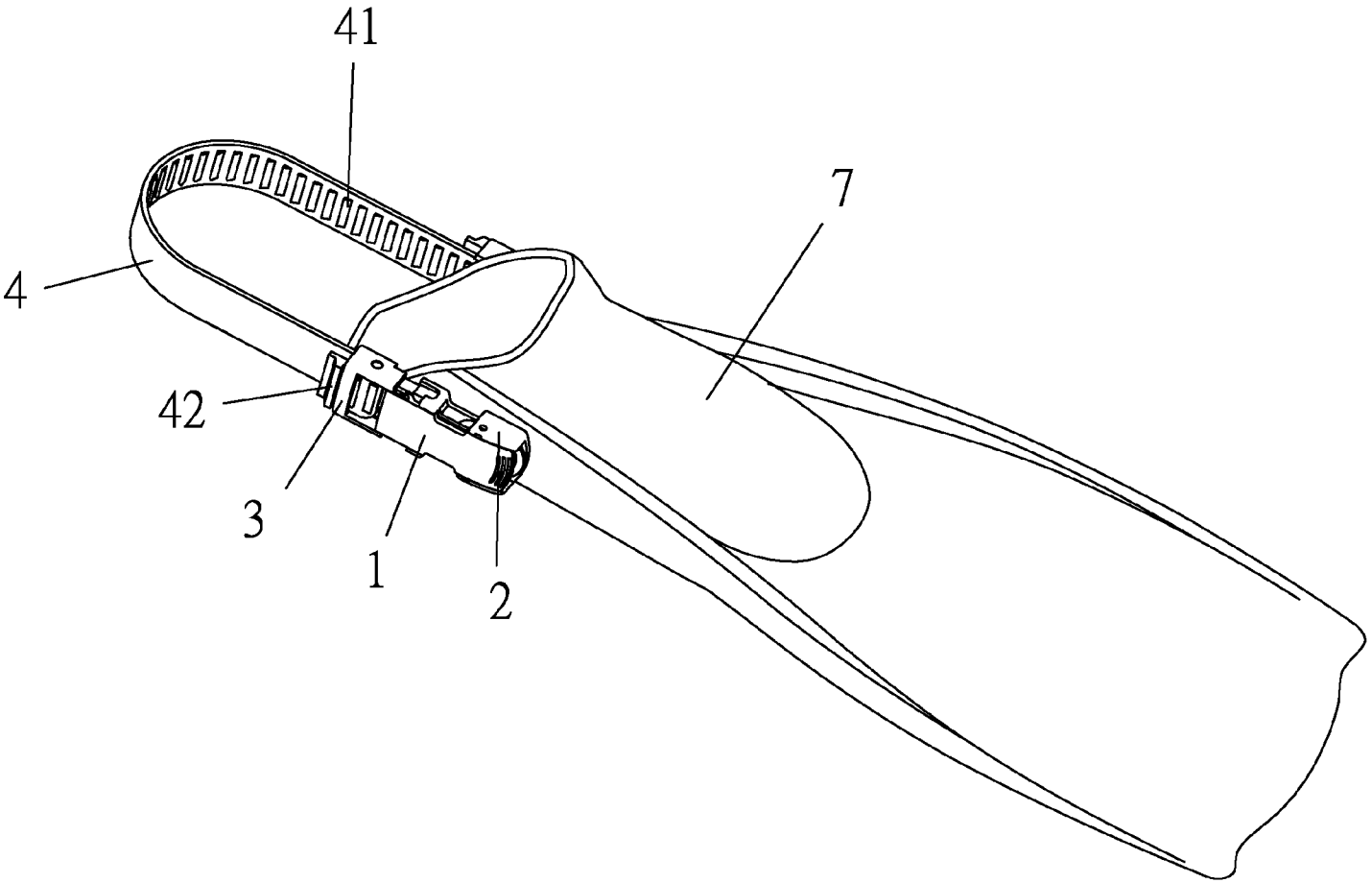
FIG. 12 is a schematic view of another preferred embodiment of the present invention.

Referring to FIGS. 11 and 12, the flippers are implemented in a combined way. Referring to FIG. 11, the buckled flippers 7 are used, and the fastening element 4 could only be adjusted unidirectionally. If the pressing strip 14 is pressed to release the fastening element 4, the flippers 7 could be adjusted. Referring also to FIG. 12, if the reed 321 is pressed, the male buckle 3 is forced to be partially separated with the female buckle 2 owing to the arrow-shaped hook 311 and the guiding plate 232, but the fastening element 4 could be adjusted bi-directionally until the male buckle 3 and the female buckle 2 are buckled, then the thrust rib plate 13 and the ribs 41 on the fastening element 4 are reset to unidirectional adjustment mode. When the male buckle 3 and female buckle 2 are loosened, since a stopper 42 is set close to the end of the fastening element 4, the fastening element 4 will not be drawn out of the male buckle 3, so the present invention could be carried by arm or fingers.

Figure 1:
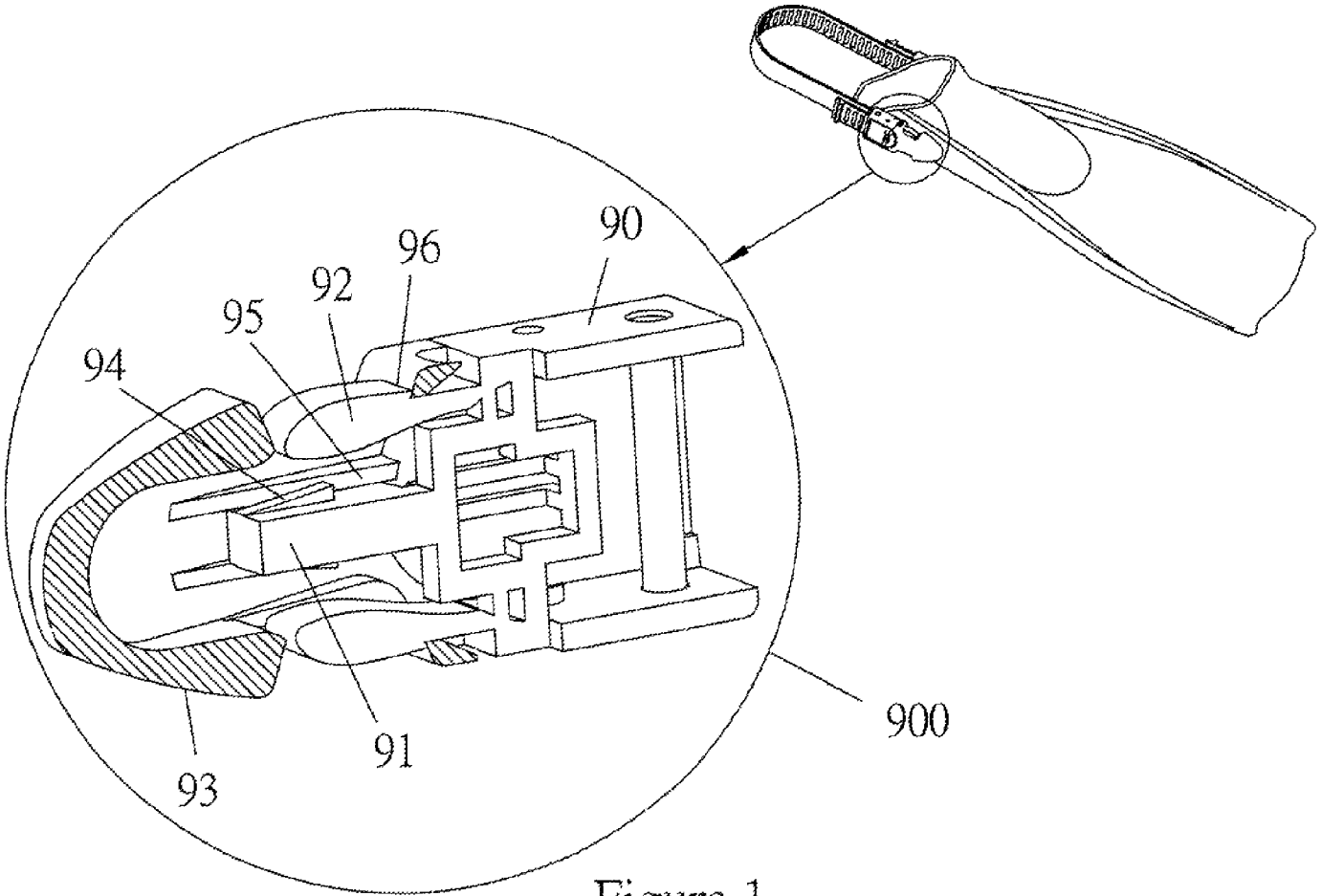
Figure 1 PRIOR ART
FIG. 1 is a schematic view (1) of a buckling mechanism of the prior art.
Figure 2:
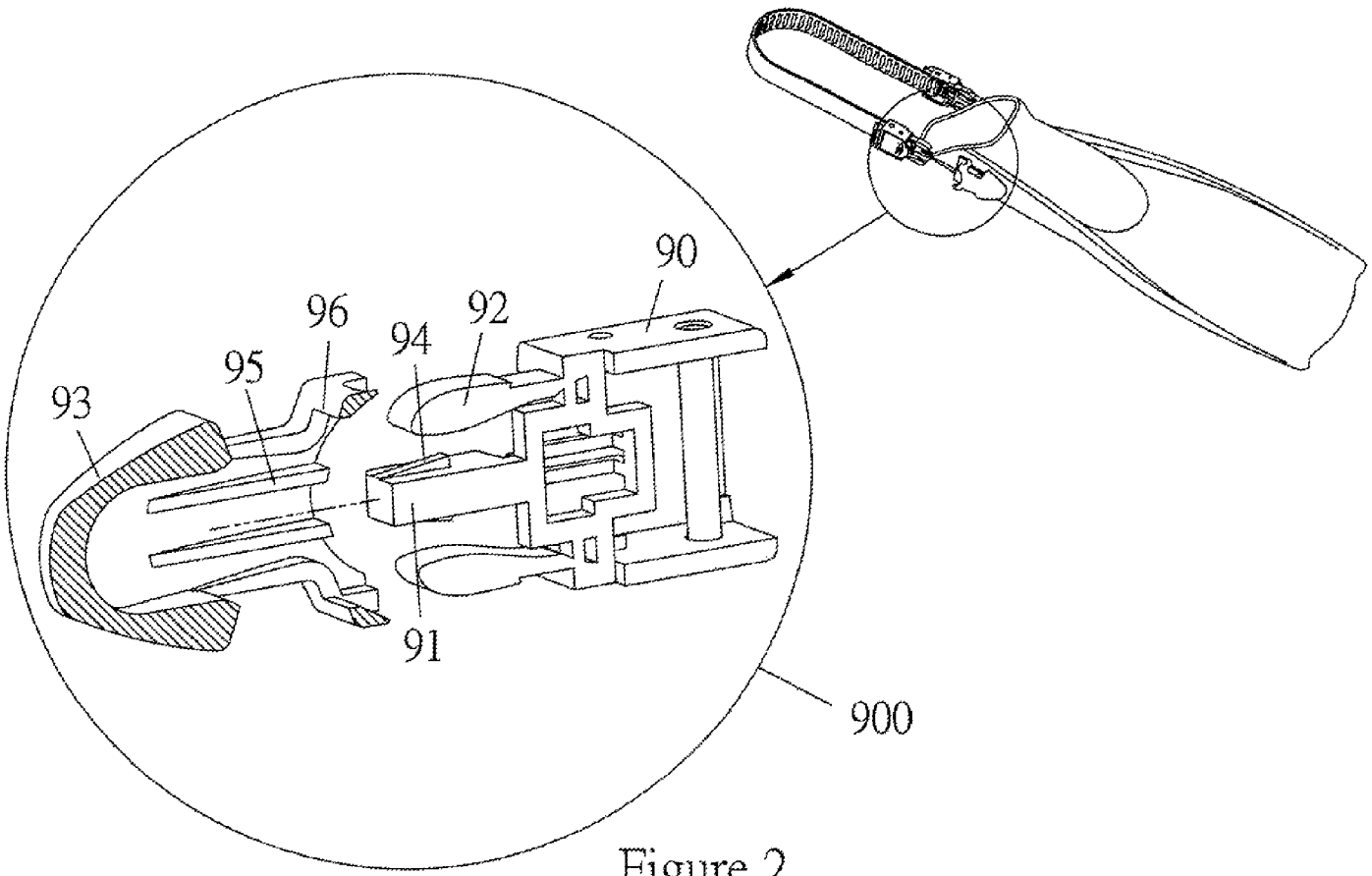
Figure 2 PRIOR ART
FIG. 2 is a schematic view (2) of a buckling mechanism of the prior art.

Referring to FIGS. 1 and 2, a buckling mechanism of prior art is shown wherein the male buckle 90 is provided with a central column 91 and two lateral columns 92. Of which the lateral column 92 is abutted with the locking flange 96 of the female buckle 93. Besides, the female buckle 93 is provided with a guiding block 95 that guides the central column 91 into the female buckle 93. The guiding block 95 is mated with the arrow-shaped pin 94 at end of the central column 91, so the male buckle 90 and the female buckle 93 only allow abutting of two lateral columns 92 with the locking flange 96. So, the male buckle 90 and the female buckle 93 could be fully separated by pressing the lateral columns 92, making it difficult to hold the loosened flippers. Referring also to FIG. 10, the male buckle 3 and female buckle 2 of the present invention are not disengaged when the arrow-shaped hook 311 is abutted with the guiding plate 232.

The above is a detailed description of the technical features of the present invention based on a typical preferred embodiment. However, it should be appreciated that the present invention is capable of a variety of embodiments and various modifications, and all such variations or changes shall be embraced within the scope of the following claims.

To sum up, the present invention has innovative technical thoughts and multiple efficacies in compliance with the stipulated novelty and inventiveness, so the claims are made hereinafter.

I claim:

1. A diving utensil comprising:

a buckling assembly having a female buckle and a male buckle, said female buckle having an opening at one end thereof and a mating joint at an opposite end thereof, said mating joint having at least one central channel and at least a pair of lateral channels formed by at least a pair of guiding plates, said female buckle having a lateral opening at opposite sides thereof and linked to the lateral channel, said male buckle having a threading portion at one end thereof, said male buckle having an extension coupled with said mating joint, said extension having at least one central column extending from a center of said extension and a pair of lateral columns extending from said extension on opposite sides of the central column, said central column having an arrow-shaped hook at one end thereof, said arrow-shaped hook matable with said guiding plates;

a fastening element having a plurality of ribs formed on one surface thereof, said fastening element located on said threading portion, said fastening element having at least one stopper adjacent an end thereof; and a seesaw pivoted onto said female buckle by a pair of fulcrums, said seesaw having a thrust rib plate matable with said plurality of ribs of said fastening element.

2. The diving utensil of claim 1, further comprising:

an elastic element positioned between said female buckle and said seesaw.

3. The diving utensil of claim 1, the lateral column of said male buckle having sequentially an elastic arm and a trough and a reed extending from said threading portion.

4. The diving utensil of claim 1, said central column of said male buckle having a forked pattern.

5. The diving utensil of claim 1, said opening of said female buckle defining a grooved seat which is provided with a buckling hole.

6. The diving utensil of claim 1, said fastening element positioned by a roller on said threading portion.

7. The diving utensil of claim 1, said seesaw having a baffle suitable for limiting a buckling range.

8. The diving utensil of claim 1, said seesaw having a pressing strip thereon.

* * * * *